United States Patent [19]

Matsuzawa et al.

[11] Patent Number: 4,514,080

[45] Date of Patent: Apr. 30, 1985

[54] APPARATUS FOR CONTROLLING OPTICAL SYSTEM FOR COPYING MACHINE

[75] Inventors: Kiyoshi Matsuzawa; Noriyuki Inoue, both of Kanagawa, Japan

[73] Assignee: Fuji Xerox Co., Ltd., Tokyo, Japan

[21] Appl. No.: 517,480

[22] Filed: Jul. 26, 1983

[30] Foreign Application Priority Data

Jul. 26, 1982 [JP] Japan ..... 57-130053

[51] Int. Cl.[3] ..... G03G 15/00

[52] U.S. Cl. ..... 355/14 C; 355/14 R; 355/8; 355/55

[58] Field of Search ..... 355/14 R, 14 C, 8, 55–57, 355/60

[56] References Cited

U.S. PATENT DOCUMENTS

| | | | |
|---|---|---|---|
| 4,323,308 | 4/1982 | Kitajima | 355/8 X |
| 4,332,461 | 6/1982 | Cail et al. | 355/8 X |
| 4,412,737 | 11/1983 | Iwanade et al. | 355/55 |
| 4,441,805 | 4/1984 | Smith | 355/55 X |

*Primary Examiner*—R. L. Moses

*Attorney, Agent, or Firm*—Sughrue, Mion, Zinn, Macpeak & Seas

[57] ABSTRACT

A memory stores values representing distances from a predetermined reference position to positions corresponding to a plurality of selectable reduction/magnification factors. Upon the selection of a desired reduction/magnification factor, the current and desired positional values, both referenced to the predetermined reference position, are compared to obtain a signal representing the distance and direction which the optical system must be moved.

5 Claims, 6 Drawing Figures

FIG. 4

| ADDRESS | 21 | REDUCTION/ MAGNIFICATION SCALE |
|---|---|---|
| 500 | 70 | 70% |
| 502 | 200 | 81% |
| 504 | 250 | 86% |
| 506 | 350 | 95% |
| 508 | 410 | 100% |
| 510 | 670 | 122% |
| 512 | 880 | 141% |

FIG. 6

| ADDRESS | 20 |
|---|---|
| 1000 | 410 |
| 1002 | 200 |

APPARATUS FOR CONTROLLING OPTICAL SYSTEM FOR COPYING MACHINE

BACKGROUND OF THE INVENTION

The present invention relates to an apparatus for controlling an optical system for a copying machine in which the number of selectable reduction/magnification factors is increased without increasing the cost of the machine.

In a conventional copying machine optical system control apparatus, for example, the position of an optical system is controlled in accordance with the reduction/magnification factor which is set by a reduction/-magnification scale button provided on a console of a copying machine. This copying machine optical control apparatus comprises reduction/magnification scale buttons for selectively producing a signal corresponding to a desired reduction/magnification factor; position detector sections the number of which corresponds to the number of selectable reduction/magnification factors and which are disposed in predetermined positions corresponding to the respective reduction/magnification factors, each for producing a position signal in accordance with the position of the optical system constituted by a lens, a mirror, etc.; a control section for receiving the reduction/magnification factor signal and the position signal to produce an optical system position control signal; and a driving section for moving the optical system in response to the control signal.

In the thus-arranged apparatus, upon the reception of the signal corresponding to a desired reduction/magnification factor, the control section actuates the driving system in accordance with the desired reduction/-magnification factor to cause the optical system to move to a predetermined position on the basis of the result of detection of the position detector sections. The size control in the lateral direction is performed by the above-mentioned positional control, while the control in the longitudinal direction is achieved by controlling the velocity of original document scanning in accordance with the desired reduction/magnification factor. An operator may obtain a copy with his desired reduction/magnification factor by the longitudinal and lateral control as described above.

However, in the conventional copying machine optical system control apparatus, when the number of selectable reduction/magnification factors is increased, the space required for the position detector sections increases and the apparatus also becomes expensive, because the number of mounting positions for optical system position control mechanisms must be increased in accordance with the available number of reduction/-magnification factors.

SUMMARY OF THE INVENTION

In view of the above-mentioned circumstances, it is an object of the invention to provide a copying machine optical system control apparatus in which it is possible to increase the number of available reduction/magnification factors. According to this invention, a memory stores position values representing the distance from a predetermined reference position to a position corresponding to each reduction/magnification factor. When the control section is instructed to change the reduction/magnification factor to a desired one, the control section compares the present position value to the desired position value to determine the relative position of the desired reduction/magnification factor position. The control section then causes the optical system to move the appropriate distance and direction to the desired reduction/magnification factor position.

BRIEF DESCRIPTION OF THE DRAWINGS

The copying machine optical system control apparatus according to the present invention will now be described with reference to the accompanying drawings, in which:

FIG. 4 is a diagram illustrating the contents of a ROM in the control section of the present invention;

FIG. 6 is a diagram illustrating the contents of a RAM in the control section of the present invention.

DETAILED DESCRIPTION OF THE DRAWINGS

Figure 1:
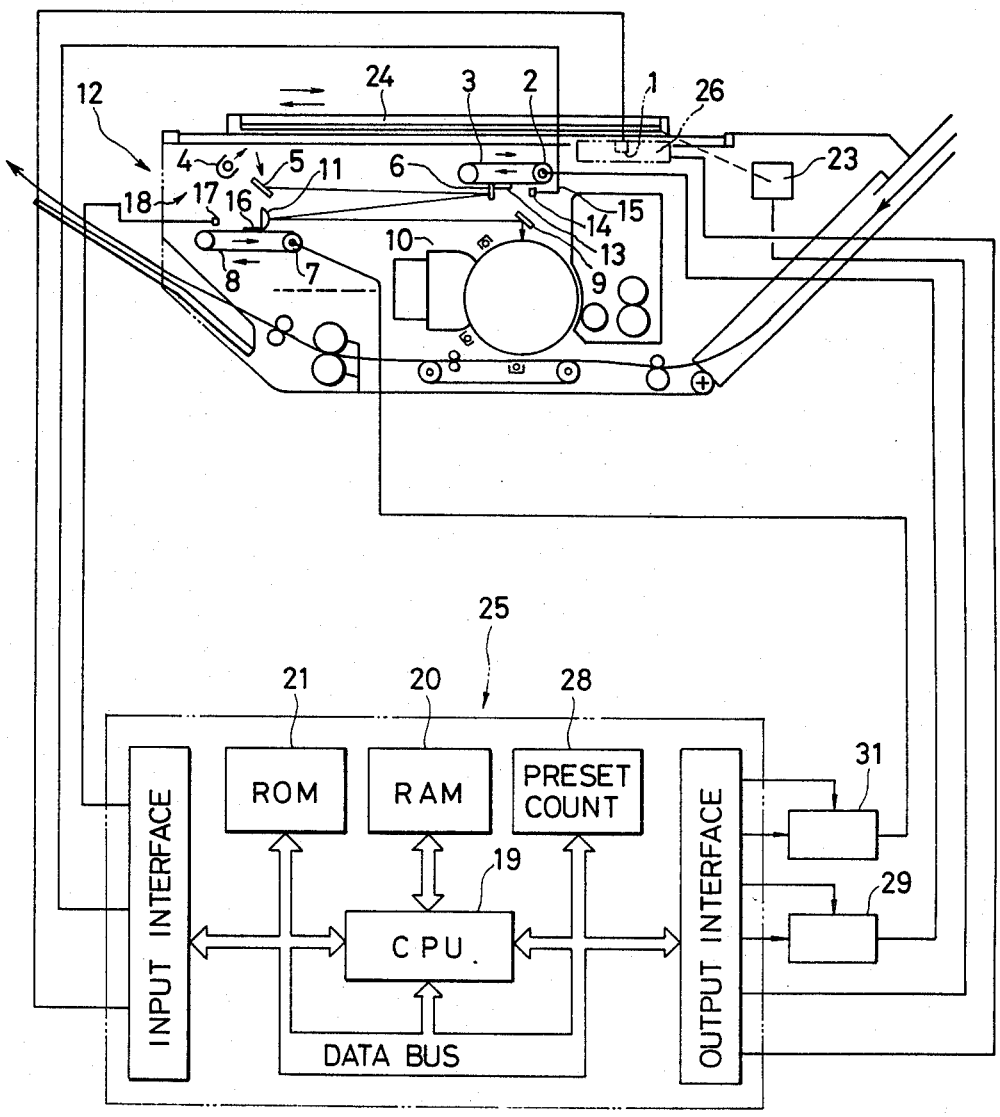
FIG. 1 is a diagram illustrating the overall configuration of an embodiment of the apparatus according to the invention.

FIG. 1 illustrates the copying machine optical system control apparatus according to the present invention, the apparatus including: reduction/magnification factor buttons 1 provided on a console 26, each for producing a reduction/magnification factor signal; and an optical system 12 comprising a mirror 6 fixed on a belt 3 driven by a stepping motor 2 and for reflecting light from a lamp 4, a mirror 5, etc., and a lens 11 fixed on a belt 8 driven by a stepping motor 7 for radiating the light reflected from the mirror 6 onto a photosensitive drum 10 via a mirror 9. The apparatus further includes a position detector section 15, comprising an actuator 13 coupled with the mirror 6, and a sensor 14; another position detector 18, comprising an actuator 16 coupled with the lens 11, and a sensor 17 for detecting the reference position of the lens 11; and a control section 25 comprising a microcomputer provided with a CPU 19, an RAM 20, a ROM 21, a preset counter 28, etc., for receiving a reduction/magnification factor signal, an optical system position signal, an optical system position calibration signal, etc. In response to these received signals, the control section 25 provides a reduction/-magnification factor selection indicating signal, a stepping motor control signal, a scanning system control signal (the scanning system being constituted by a motor 23, a movable original document platen 24, etc.) etc. The apparatus finally includes stepping motor driving sections 28 and 29 for respectively individually driving the stepping motors 2 and 7.

Figure 2:
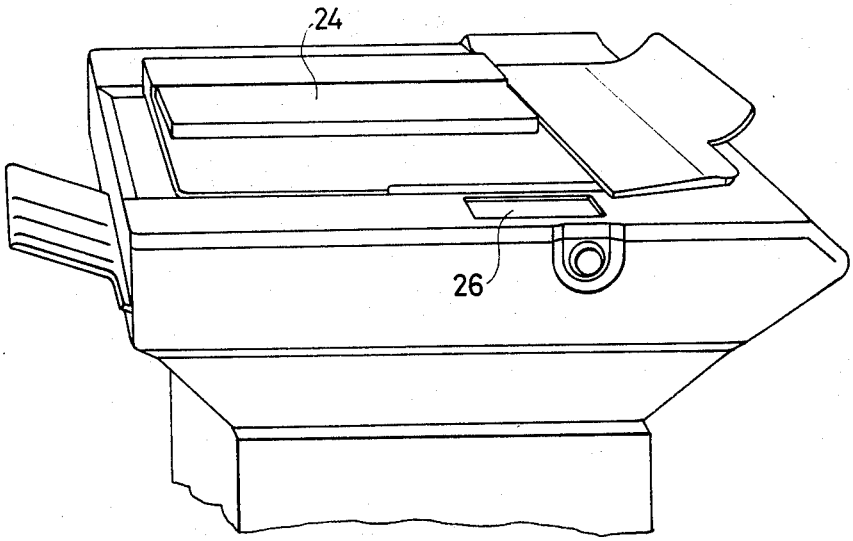
FIG. 2 is a perspective view of an embodiment of the console according to the present invention.
Figure 3:
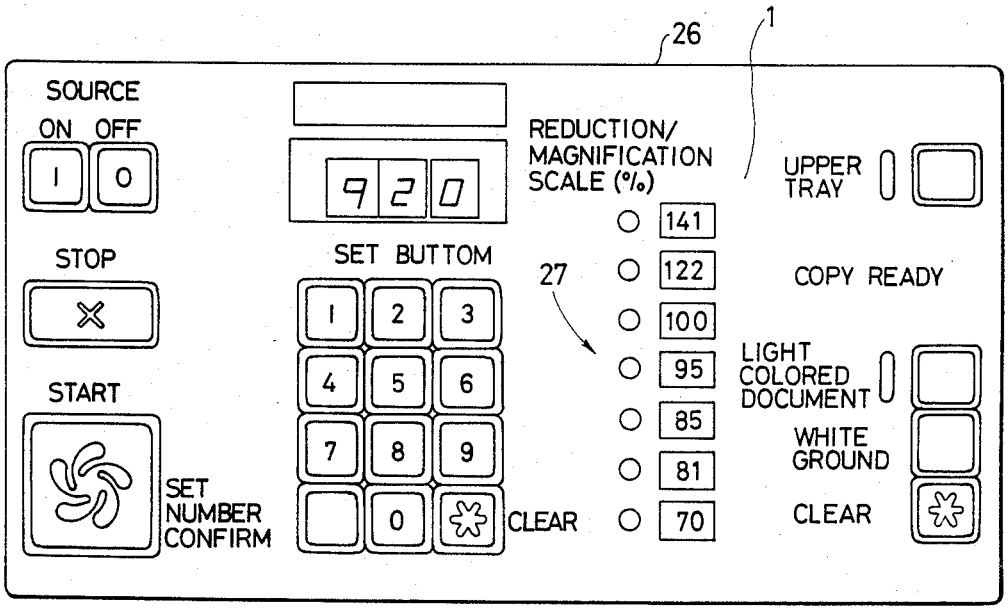
FIG. 3 is a plant view of the console of FIG. 2.

As shown in FIGS. 2 and 3, the reduction/magnification factor buttons 1 are provided on the console 26 of the copying machine, and a plurality of indication sections 27 are provided corresponding to respective ones of the buttons 1 so as to indicate a selected reduction/-magnification factor. The microcomputer ROM 21, shown in FIG. 4, stores the numbers of pulses corresponding to the distances between the mirror 6 and sensor 14 and between the lens 11 and sensor 17 in the optical system, for each of the selectable reduction/-magnification factors, i.e., the number of input pulses which must be applied to each of the stepping motors 2 and 7 for moving the mirror 6 and the lens 11 to the respective predetermined positions from the respective positions of the sensors 14 and 17.

The ROM 21 also stores a program for as soon as the power supply is turned on, moving the respective optical systems to their positions corresponding to a 100% reduction/magnification factor, for lighting the 100% indication section, and for deriving from the ROM 21 a signal, e.g. the pulse number "410", corresponding to the current optical positions (in this case, the positions of the mirror 6 and the lens 11 corresponding to the 100% reduction/magnification factor, so as to put them into predetermined addresses of the RAM 20. This program may also be employed after a predetermined time has elapsed during which no copying operations have been performed at other magnification factors. Another program is stored in the ROM 21 for moving the respective optical systems to their reference positions (the positions at which the respective sensors are disposed) when optical system position correction signals are inputted to the control section 25. Neither of these stored programs per se constitute the present invention, and both are very straightforward and easily derived by ordinarily skilled artisans. Thus, neither need be described in detail herein.

The operation of the thus-arranged control apparatus will now be described with reference to FIGS. 4 through 6.

Upon the turning-on of the power source for the copying machine, if the optical systems are not already arranged at the appropriate positions for providing a 100% reduction/magnification factor, the respective optical system control mechanisms are actuated in response to a source turning-on signal to arrange the respective optical systems at positions corresponding to a 100% reduction/magnification factor. (In many cases, this operation will be unnecessary since the copying machine will most often be used at the 100% reduction/magnification factor.) Then, as shown in FIGS. 4 and 6, a signal indicating the the current positions of the respective optical systems, e.g. a signal "410", is retrieved from the address 508 of the ROM 21 and stored in the address 1,000 of the RAM 20.

Figure 5:
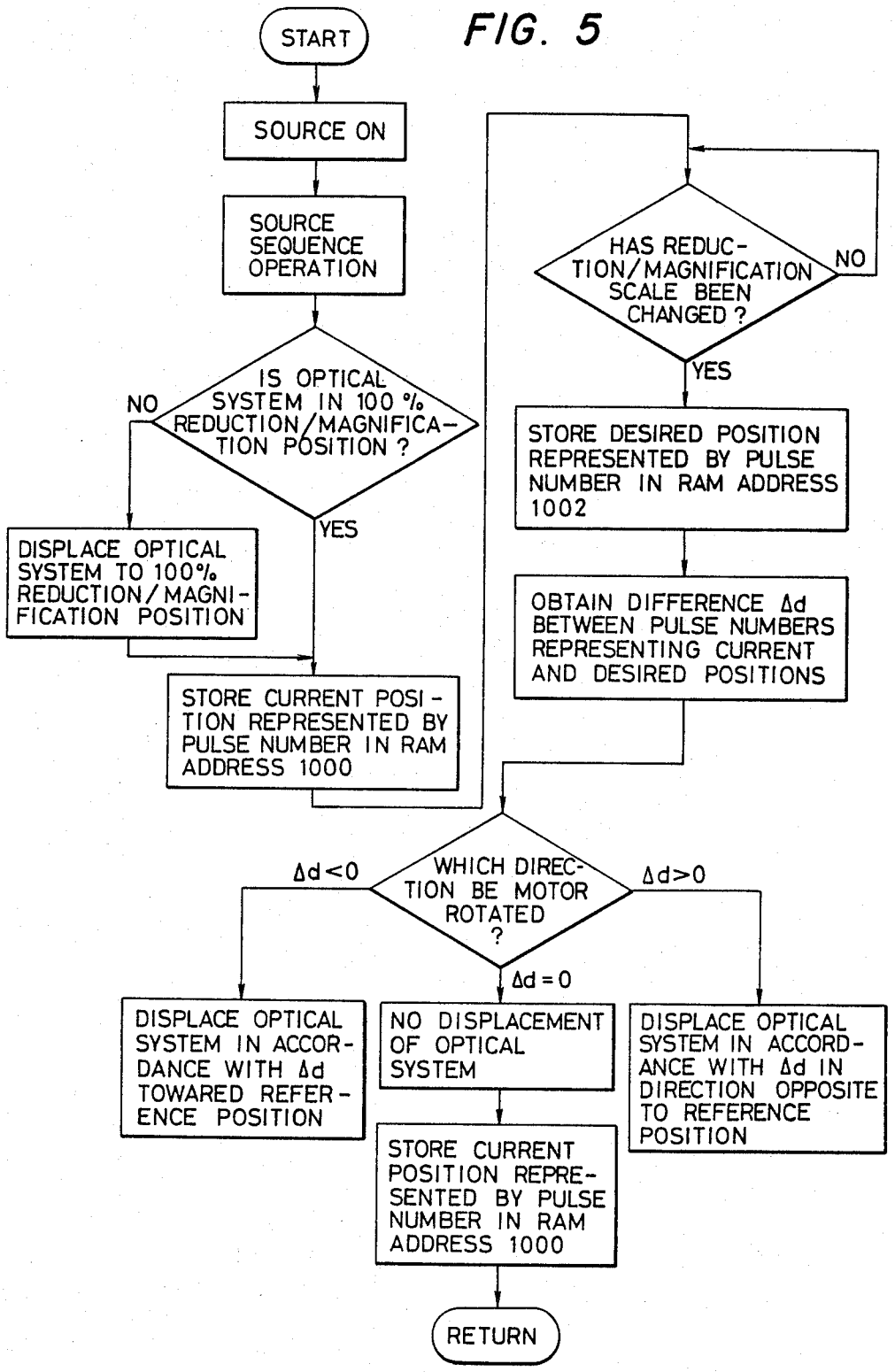
FIG. 5 is a flow-chart showing the operation of the apparatus according to an embodiment of the present invention.

If the reduction/magnification factor is to be changed at this time, operations are performed on the basis of the flowchart shown in FIG. 5. For example, if the reduction/magnification factor is to be changed from 100% to 81%, the control section 25 retrieves the pulse number "200" indicating the 81% reduction/magnification factor out of the address 502 of the ROM 21, stores it in the address 1,002 of the RAM 20, lights the 81% reduction/magnification scale indication section, and substracts the pulse number "200" in the address 1,002 of the RAM 20 from the pulse number "410" in the address 1,000 of the same RAM 20 to obtain the pulse number "210". This pulse number "210" corresponds to the amount of displacement of the mirror 6 and the lens 11 necessary to change the optical system from the 100% to the 81% reduction/magnification factor.

On the basis of this calculation result, the control section 25 sets the preset counter 28 to this value "210" and at the same time produces a revolution direction instruction signal to cause the respective stepping motors 2 and 7 to rotate in a forward direction. The preset counter 28, in a well-known manner, counts down in response to pulses corresponding to discrete movement quantities and continues to produce an output signal until the set value "210" becomes zero, so that the respective stepping motors 2 and 7 rotate in the indicated revolution direction by the amounts corresponding to the pulse number "210", to thereby move the mirror 6 and the lens 11 to their optical positions to corresponding to the 81% reduction/magnification factor. When the respective optical systems 15 and 18 have been moved to the 81% reduction/magnification factor positions, the pulse number "200" indicating the current reduction/magnification factor position is stored in the address 1,000 of the RAM 20.

When the reduction/magnification factor is changed from 100% to 141%, the control section 25 performs substraction similar to the above-mentioned case, i.e., $410-880=-470$, and causes the stepping motors 2 and 7 to rotate by an amount corresponding to the pulse count "470" in the reverse (negative) direction so as to move the optical systems to the positions corresponding to a 141% reduction/magnification factor, then storing the pulse number "880" in the address 1,000 of the RAM 20.

Thus, every time a desired one of the reduction/magnification factor buttons 1 is actuated, the above-mentioned operation is performed to arrange the optical systems in accordance with the selected reduction/magnification factor.

Since all movements of the optical systems are to "relative" positions rather than "absolute" positions, it may be advisable to occasionally return the optical systems to a reference position to maintain accuracy of positioning. To this end, if an optical position calibration signal is inputted to the control section 25 at any time, the mirror 6 and the lens/mirror 11 are returned back to their reference positions (the positions at which the sensors 14 and 17 are provided), thereby performing calibration.

Further, since the control section described above causes the optical system to move from a starting optical position corresponding to a 100% reduction/magnification factor in response to selection of a reduction/magnification factor, it is unnecessary to provide optical position detecting sections corresponding to each of the respective reduction/magnification factors. Thus, the reduction/magnification factor selection number is increased without increasing the cost of the machine.

We claim:

1. An apparatus for controlling an optical system in a copying machine, said optical system being movable to a plurality of positions at which different reduction/magnification factors are obtained, said apparatus comprising:

first means for generating a first signal corresponding to a desired one of said plurality of reduction/magnification factors;

second means responsive to said first signal for providing a desired position signal representing the distance from a predetermined reference position to the position corresponding to said desired reduction/magnification factor;

third means for generating a current position signal corresponding to the distance from said predetermined reference position to the present position of said optical system;

fourth means responsive to said current and desired position signals for generating a difference signal representing the distance and direction from said current position to said desired position; and fifth means responsive to said difference signal for moving said optical system to said desired position.

2. A control apparatus as claimed in claim 1, wherein said second means comprises a read only memory (ROM).

3. A control apparatus as claimed in claim 1, wherein said second through fourth means together comprise:

a read only memory (ROM) for storing position signals corresponding to each of said plurality of magnification factors;

a random access memory (RAM) for storing said current position signal at a first location;

computer means for storing said current position signal in a first address of said RAM, said computer means being responsive to said first signal for retrieving said desired position signal from said ROM, comparing said desired position signal to said current position signal to generate said difference signal, and storing said desired position signal at said first location as a new current position signal upon movement of said optical system to said desired position.

4. A control apparatus as claimed in claim 1, wherein said fifth means comprises a source of pulses, drive means responsive to each pulse for moving said optical system a predetermined amount; a counter for counting down said pulses; means for presetting said counter to a value corresponding to said difference signal; and means for terminating one of said drive means and said pulses at a predetermined count in said counter.

5. An apparatus for controlling an optical system for a copying machine, said optical system including at least one optical element movable to between at least a current position and a desired position at which said copying machine achieves current and desired reduction/magnification factors, said apparatus comprising means for generating a desired position signal representing the distance from a reference position to said desired position; means responsive to the selection of said desired reduction/magnification factor for receiving said desired position signal and generating a distance signal representing the distance from said current position to said desired position; and means responsive to said distance signal for moving said optical element to said desired position.

* * * * *